US007762436B2

(12) United States Patent
Neuhaus et al.

(10) Patent No.: US 7,762,436 B2
(45) Date of Patent: Jul. 27, 2010

(54) METERING VALVE AND DEVICE FOR DISPENSING A PREFERABLY COSMETIC LIQUID

(75) Inventors: Reinhard Neuhaus, Hemer (DE); Bernhard Jasper, Waltrop (DE)

(73) Assignee: Seaquist Perfect Dispensing GmbH, Dortmund (DE)

( * ) Notice: Subject to any disclaimer, the term of this patent is extended or adjusted under 35 U.S.C. 154(b) by 833 days.

(21) Appl. No.: 11/570,867

(22) PCT Filed: Jun. 17, 2005

(86) PCT No.: PCT/EP2005/006532

§ 371 (c)(1), (2), (4) Date: Dec. 18, 2006

(87) PCT Pub. No.: WO2005/123543

PCT Pub. Date: Dec. 29, 2005

(65) Prior Publication Data

US 2008/0272155 A1 Nov. 6, 2008

(30) Foreign Application Priority Data

Jun. 17, 2004 (DE) ..... 10 2004 029 146
Jul. 16, 2004 (DE) ..... 10 2004 034 626

(51) Int. Cl.
*B65D 83/00* (2006.01)

(52) U.S. Cl. ..... 222/402.2; 222/402.1; 222/402.24

(58) Field of Classification Search ..... 222/402.2, 222/1, 402.1, 394, 402.22, 402.23, 402.24, 222/402.16, 402.25; 141/20; 251/353–354
See application file for complete search history.

(56) References Cited

U.S. PATENT DOCUMENTS

| | | | | |
|---|---|---|---|---|
| 2,721,010 | A | | 10/1955 | Meshberg |
| 2,837,249 | A | | 6/1958 | Meshberg |
| 3,018,928 | A | | 1/1962 | Meshberg |
| 3,055,560 | A | | 9/1962 | Meshberg |
| 3,073,489 | A | | 1/1963 | Friedman |
| 3,272,442 | A | * | 9/1966 | Allenbach et al. ..... 239/579 |
| 3,447,551 | A | * | 6/1969 | Braun ..... 137/43 |
| 3,583,608 | A | * | 6/1971 | Green ..... 222/402.24 |
| 3,589,571 | A | * | 6/1971 | Green et al. ..... 222/402.24 |
| 3,666,148 | A | * | 5/1972 | Webster ..... 222/396 |

(Continued)

FOREIGN PATENT DOCUMENTS

GB 2198117 A * 6/1988

(Continued)

*Primary Examiner*—Frederick C. Nicolas
(74) *Attorney, Agent, or Firm*—David S. Safran; Roberts Mlotkowski Safran & Cole, P.C.

(57) ABSTRACT

A metering valve (2) and a device (1) provided with it for metered dispensing of a preferably cosmetic liquid (3) and a process for producing such a metering valve and a use of such a metering valve. The metering valve preferably has a sealing element (14) which is injection molded onto the valve element (6) or a valve housing (7) or attached in some other way so that simple and economical production by injection molding is enabled. Optimum sealing is achieved in that the sealing element, at least in sections, is made at least annular or sleeve-shaped, seals radially with the inlet valve closed, and is supported either radially inside or outside.

23 Claims, 3 Drawing Sheets

U.S. PATENT DOCUMENTS

| | | | | | |
|---|---|---|---|---|---|
| 3,722,759 | A | * | 3/1973 | Rodden | 222/396 |
| 4,362,257 | A | * | 12/1982 | Shay | 222/402.2 |
| 4,413,755 | A | * | 11/1983 | Brunet | 222/402.2 |
| 4,597,512 | A | * | 7/1986 | Wilmot | 222/402.2 |
| 4,811,868 | A | * | 3/1989 | Nitta | 222/402.2 |
| 5,037,013 | A | * | 8/1991 | Howlett | 222/402.2 |
| 5,169,038 | A | * | 12/1992 | Di Giovanni | 222/402.2 |
| 5,769,283 | A | | 6/1998 | Owada et al. | |
| 6,131,777 | A | * | 10/2000 | Warby | 222/402.2 |
| 6,619,515 | B1 | * | 9/2003 | Abplanalp et al. | 222/402.21 |
| 6,978,916 | B2 | | 12/2005 | Smith | |
| 7,234,460 | B2 | * | 6/2007 | Greenleaf et al. | 128/200.23 |
| 7,651,014 | B2 | * | 1/2010 | Neuhaus et al. | 222/402.2 |
| 2002/0190085 | A1 | | 12/2002 | Stanford | |
| 2003/0071080 | A1 | | 4/2003 | Yquel | |
| 2004/0139966 | A1 | | 7/2004 | Hodson | |

FOREIGN PATENT DOCUMENTS

| | | | |
|---|---|---|---|
| JP | 7 251884 | A | 10/1995 |

* cited by examiner

METERING VALVE AND DEVICE FOR DISPENSING A PREFERABLY COSMETIC LIQUID

BACKGROUND OF THE INVENTION

1. Field of the Invention

This invention relates to a metering valve for dispensing a preferably cosmetic liquid, a device with such a metering valve, a process for producing such a metering valve and use of such a metering valve or such a device.

2. Description of Related Art

The concept of "cosmetic liquid" includes, in a narrow sense, hair spray, hair lacquer, a deodorant, a foam, a gel, a coloring spray, a sunscreen or skin care agent or the like. Preferably, in a wider sense also other body care products, cleaning products, cosmetics, or the like, and also suspensions and fluids, especially with gaseous phases, are included. However, other liquids, for example, air fresheners, and especially also technical liquids and fluids, such as rust looseners or the like, can also be used. But, for reasons of simplification and based on the focus of use, often, only cosmetic liquids are addressed below.

U.S. Patent Application Publications 2003/0190085 A1 and 2003/023063 disclose a devices for metered atomization of a cosmetic liquid, a container containing the liquid having a metering valve with a movable valve element in a valve housing. The valve element together with the valve housing forms a supply-side inlet valve and a dispensing-side outlet valve. The valve element is preferably provided with a slipped-on spray head or the like for dispensing and atomization of the liquid. By pressing down the spray head the valve element is moved axially, by which first the supply-side inlet value of the metering valve is closed and only then is the dispensing-side outlet valve of the metering valve opened. Then, the liquid which preferably contains a propellant can escape from the metering space formed in the valve housing and can be atomized and delivered by the connected spray head.

To fill containers with a cosmetic liquid under pressure, in addition to the so-called "undercup" process in which filling is done by lifting or before setting a cover with the metering valve on the container, therefore before actual closing of the container, bypassing the metering valve, increasingly so-called "pressure filling" is used in which filling takes place through the metering valve or past the metering valve between the cover and a dispensing-side sealing element of the metering valve. Higher filling pressures are being increasingly used in filling in order to reduce the filling time.

The known metering valves are not ideal for pressure filling and/or for sealing and/or do not allow optimum securing of the seal with a simple structure.

SUMMARY OF THE INVENTION

The object of this invention is to devise a metering valve and a device for metered dispensing of a preferably cosmetic liquid and a process for producing such a metering valve and use of such a metering valve or such a device, the metering valve that is able to be produced easily, seal better and/or be used in a more versatile manner.

This object is achieved by a metering valve, a device, a process and a use as described below.

The basic idea of this invention is to make the sealing element at least partially essentially annular or sleeve-shaped. With the inlet valve closed, the sealing element seals at least essentially radially. The sealing element is supported either radially inside or outside at least in the sealing region. This enables sealing which is better compared to the prior art, especially since the sealing element is preferably made of a soft material is prevented from yielding radially.

If necessary, the valve seat or the sealing element can also be made conical in order to achieve an optimum radial seal seat in the closed state.

According to another idea of this invention which can be implemented independently, the sealing element is secured or fixed on the valve element or valve housing by means of a reset spring which is assigned to the valve element. This allows reliable fixing of the sealing element with a simple structure and with simple manufacture of the metering valve, since a reset spring is ordinarily installed anyway. Other measures, for example, clamping of the sealing element between the valve housing parts, become superfluous. This therefore allows simplification of the structure and mounting of the metering valve.

The sealing element for sealing between the valve element and the valve housing with the inlet valve closed is preferably made of a softer or more elastic material than the valve element and the valve housing. This enables a stable execution of the metering valve, especially of the valve housing which can accordingly better withstand high propellant and filling pressures. Therefore, the metering valve in accordance with the invention and the device provided with such a metering valve can be used in a versatile manner.

According to an especially preferred embodiment, the sealing element is formed directly on the valve element. This can be done, for example, directly in the injection mold for the valve element. If necessary, the sealing element can also be inserted as a prefabricated part into the injection mold and the valve element can be injected onto the sealing element. In both cases, especially simple and economical production is enabled, and mounting can take place in the previously conventional manner without an additional mounting step for the sealing element.

The corresponding advantages arise when the sealing element is attached to the valve element especially by slipping it on.

Preferably, the sealing element is located in the region of the free end on the valve element. This is especially beneficial to a correspondingly end-side arrangement of the inlet valve and possible slipping of the sealing element onto the valve element.

However, the sealing element, for example, can also be located, especially injected on, in a region of the valve element spaced apart from the end of the valve element.

According to another embodiment, the sealing element is injected onto the valve housing or the valve housing is injected onto the sealing element. This enables simple and thus economical production, and mounting of the metering valve can take place as in the past.

Alternatively, the sealing element can also be inserted into the valve housing. This enables greater degrees of freedom in production, especially of the sealing element.

Preferably, the sealing element, the valve element and the valve housing are injection molded from plastic in order to enable economical mass production.

Preferably, injection molding takes place with such precision and such a selection of materials that reworking to achieve the desired sealing action is unnecessary.

In particular, the sealing element is made self-locking. This can be achieved, for example, by the sealing element engaging a preferably undercut recess of the valve element or of the valve housing. However, this is especially preferably achieved by the sealing element being injection molded directly onto the valve element or the valve housing or being injection molded into it, or vice versa in order to achieve a permanent connection.

The valve element especially preferably forms both the inlet valve and also the outlet valve of the metering valve. For this purpose, the valve element is made preferably at least essentially rigid, especially in the actuation direction or axial direction.

The metering valve is used especially preferably for metered dispensing of a cosmetic liquid which contains particles, distributed projections in the metering space of the metering valve being used for temporary deposition of particles to counteract bottom-side settling of particles and especially clogging of the inlet valve, the particles which have settled on the projections being discharged by the liquid during dispensing at the same time. This enables improved distribution of particles in the discharged liquid. This is beneficial to particle-containing formulations or suspensions which are being increasingly used to be able to ensure distributions as uniform as possible and thus uniform properties.

Other advantages, features, properties and aspects of this invention will become apparent from the following description of preferred embodiments with reference to the accompanying drawings.

DETAILED DESCRIPTION OF THE INVENTION

The same reference numbers are used for the same or similar parts in the figures, the corresponding or comparable properties and advantages being achieved even if a repeated description is omitted.

Figure 1:
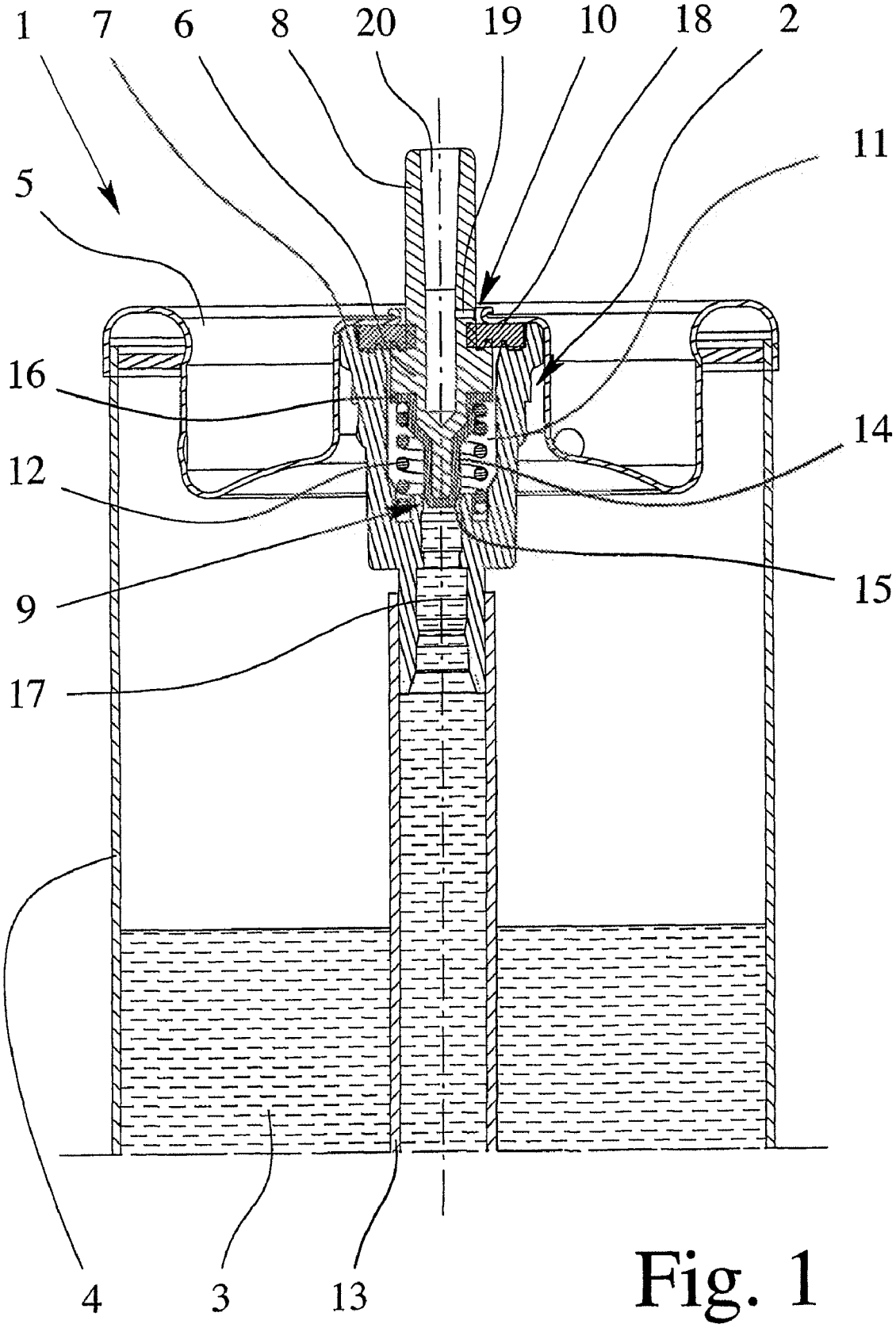
FIG. 1 is a schematic cross-sectional view of a device in accordance with the invention with a metering valve in accordance with the invention for metered dispensing of a cosmetic liquid according to a first embodiment.

FIG. 1 shows in a schematic cross section a device 1 in accordance with the invention with a metering valve 2 for metered dispensing of a preferably cosmetic liquid 3 or the like. In particular, dispensing of liquid 3 proceeds via a spray head (not shown) and which is connected to the metering valve 2, preferably slipped on it, for atomization and delivery of the liquid 3.

The liquid 3 is under pressure or can be pressurized. In particular, the liquid 3 contains a propellant, preferably a volatile and/or flammable propellant, compressed gas, carbon dioxide or the like. Especially preferably, the cosmetic liquid 3 in the initially named sense is a particle-containing mixture or suspension.

The device 1 also has a container 4 for the liquid 3 and a cover 5 which bears the metering valve 2.

The metering valve 2 has a movable valve element 6 and a valve housing 7. The valve element 6, in the illustrated embodiment, is guided to be axially movable in the valve housing 7, vertically in FIG. 1, and on the dispensing side has a projecting connector piece 8 for connection of the spray head (not shown), or the like.

The metering valve 4 has a supply-side inlet valve 9, a dispensing-side outlet valve 10 and a metering space 11 formed in between in the valve housing 7.

In the metering space 11, there is a reset spring 12 which is assigned to the valve element 6 and which pretensions the valve element 6 into the illustrated, inactive position, here, therefore up.

In the inactive position, the outlet valve 10 is closed and the inlet valve 9 is opened. In this state, the metering space 11 is filled with the liquid 3 (this is not shown in the figures for reasons of simplification), the liquid 3 being able to flow out of the container 4 via a supply-side ascending line 13 through the open inlet valve 9 into the metering space 11.

When the valve element 6 is actuated—therefore, when the valve element 6 is pressed down against the force of the reset spring 12—first, the inlet valve 9 is closed and only afterwards is the outlet valve 10 opened. In this actuated state, then the liquid 3 located in the metering space 11 can be dispensed via the opened outlet valve 10, especially due to the indicated propellant it can flow out independently, and for example, can be sprayed or atomized by the spray head (not show) and which is connected to the connector piece 8. The metering valve 2 accordingly dispenses only a certain or metered amount of liquid 3 with each actuation.

When the metering valve 2 is reset into the inactive position, first the outlet valve 10 is closed and only then is the inlet valve 9 opened in order to allow the liquid 3 to flow into the metering space 11.

The valve element 6 and the valve housing 7 are preferably each made in one piece and are injection molded from plastic, especially from a relatively hard or stiff plastic, such as polyamide or polyoxymethylene (POM).

To seal the inlet valve 9 in the closed state, in accordance with the invention in addition between the valve element 6 and the valve housing 7 there is a sealing element 14 of a softer or more elastic material than the valve element 6 and the valve housing 7.

In the first embodiment shown in FIG. 1, the sealing element 14 is injection molded onto the valve element 7, preferably directly in the injection mold used to produce the valve element 6 or in a separate injection mold. Alternatively, the sealing element 14 can also be inserted, for example, as a prefabricated part into the injection mold and the valve element 6 can be injected onto it or the sealing element 14 can be slipped onto the prefabricated valve element 6.

The sealing element 14 surrounds the valve element 6 preferably annularly, and in the illustrated embodiment has a truncated cone-shaped or rounded insertion area 15 to facilitate insertion into a corresponding sealing section of the valve housing 7 for preferably radially sealing against the sealing element 14 when the inlet valve 9 is closed.

In the first embodiment, the sealing element 14 has a side projection, especially a ring flange 16 or the like for fixing on the valve element 6, the projection or ring flange 16 being located between an abutment for the reset spring 12 on the valve element 6 and the assigned end of the reset spring 12 and is thus fixed. This enables very reliable fixing of the sealing element 14 on the valve element 6, especially also when the sealing element 14 is injected onto the valve element 6 since for different materials loosening of the sealing element 14 from the valve element 6 cannot always be completely precluded.

Of course, the sealing element 14 alternatively can also be located and fixed in the corresponding manner on the valve housing 7.

The sealing element 14 is preferably also injection molded, especially from a suitable elastomer, preferably from a thermoplastic elastomer (TPE), a thermoplastic polyurethane (TPU) or a low density polyethylene produced under high pressure (LDPE).

Injection molding enables economical mass production, especially reworking of the seal surfaces—on the one hand, on the sealing element 14, and on the other hand, on the valve element 6 or the valve housing 7—not being necessary.

The injection molding of the sealing element 14 onto the valve element 6 or the valve housing 7 has the advantage that the sealing element 14 does not form a separate part and therefore does not require a separate mounting step and moreover has the further advantage that very good sealing can be achieved between the sealing element 14 and the valve element 6 or valve housing 7 connected to it without additional measures.

In the first embodiment, the sealing element 14 is located on a free end of the valve element 6 such that, in the inactive state, an axial supply channel 17 in the valve housing 7 to the metering space 11 is not blocked. In the actuated state—therefore, with the valve element 6 pressed down—the valve element 14 is preferably inserted at least partially with the front end of the valve element 6 into the supply channel 17 for radial sealing on the sealing section of the valve housing 7. However, fundamentally, also other valve designs are possible, for example, a plate-like execution and/or axial sealing.

The outlet valve 10, in the illustrated embodiment, has a separate sealing element 18 which is especially made annular and is sealed by the valve housing 7 against an annular section of the cover 5. The separate sealing element 18 seals radially relative to the shaft section of the valve element 6 or the connector piece 8. In the illustrated inactive state, the outlet valve 10 is closed, and accordingly, no liquid 3 can emerge from the metering space 11 on the dispensing side.

When the valve element 6 is actuated, the valve element 6 or the connector piece 8 is shifted axially such that a radial passage channel 19 moves past the separate sealing element 18 into the interior of the valve head 7, therefore is opened toward the metering space 11 (this position is not shown). Thus, the outlet valve 10 is opened, and the liquid 3 can flow out of the metering space 11 through the passage channel 19 into an axial recess 20 and through the latter out of the connector piece 8 into the spray head (not shown), or the like.

Other embodiments of the device 1 in accordance with the invention with the metering valve 2 are explained in detail below, only important differences compared to the first embodiment as shown in FIG. 1 being emphasized. Therefore, otherwise, the previous explanations apply accordingly or in a complementary manner.

Figure 2:
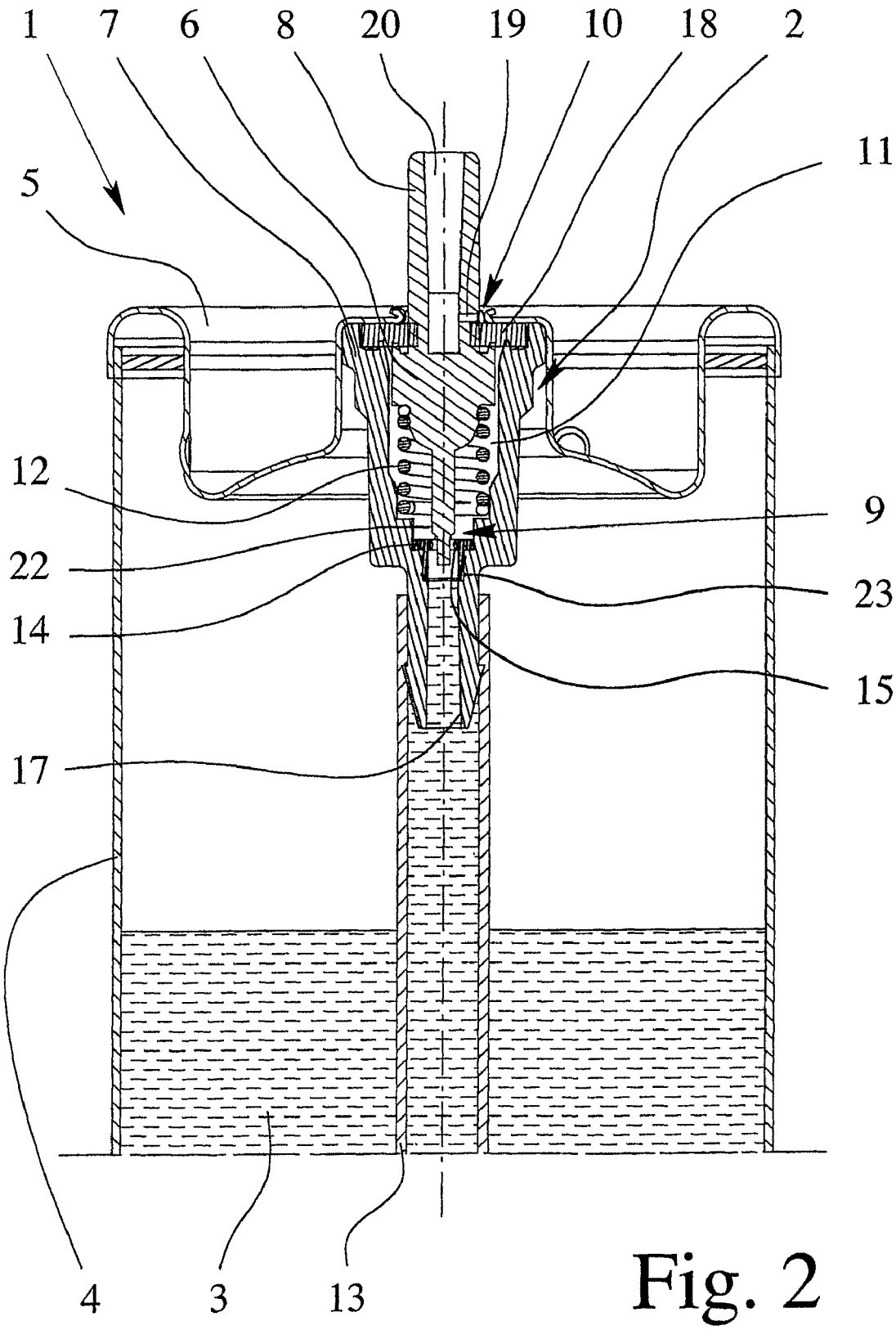
FIG. 2 is a schematic cross-sectional view of a device in accordance with the invention with a metering valve in accordance with the invention for metered dispensing of a cosmetic liquid according to a second embodiment.

In the second embodiment as shown in FIG. 2, the sealing element 14 is attached, especially injected onto the valve housing 7. Preferably, the sealing element 14, which is ring-shaped or sleeve-shaped here, preferably engages at least one undercut recess 25 of the valve housing 7—or in an arrangement on the valve element 6—of the valve element 6. In the illustrated embodiment, two essentially annular recesses 23 and a shoulder-like widening are formed to accommodate and hold the sealing element 14.

Figure 3:
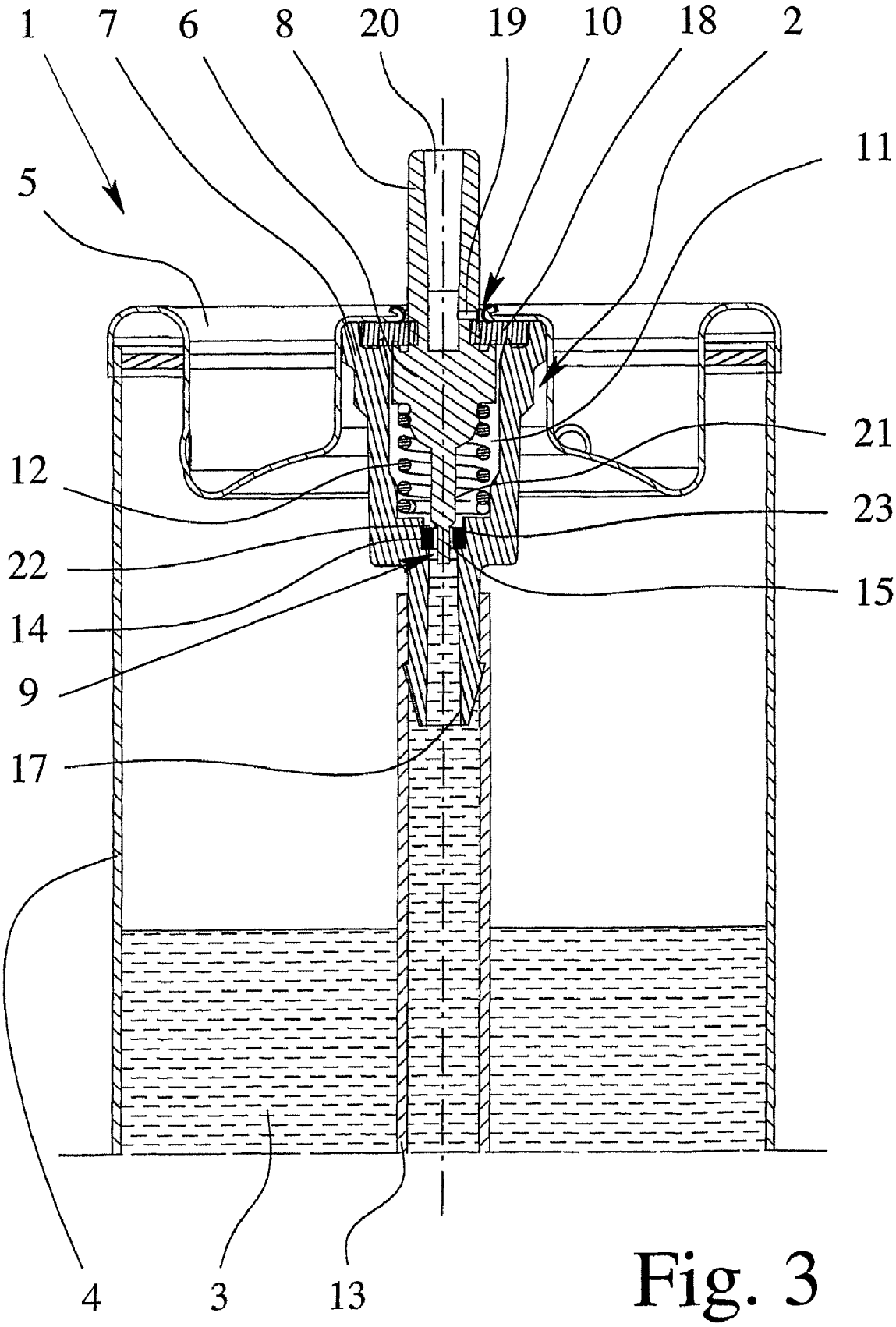
FIG. 3 is a schematic cross-sectional view of a device in accordance with the invention with a metering valve in accordance with the invention for metered dispensing of a cosmetic liquid according to a third embodiment.

In the third embodiment, as shown in FIG. 3, the preferably separately made, ring-shaped or sleeve-shaped sealing element 14 is inserted or injected into the valve housing 7, and in turn, preferably engages the recess 23.

In the second and third embodiments, a radial seal is formed between the sealing element 14 and the end section of the valve element 6 which has been inserted when the inlet valve 9 has been closed. Therefore, the sealing element 14 seals at least essentially radially as in the first embodiment.

If necessary, individual aspects, features and properties of the above explained embodiments can be combined with one another or replaced by one another. In particular, also other valve designs are possible. If necessary, the sealing element 14 which has been injection molded on, or optionally, can also be used for other valves—i.e., independently of this metering valve 2—for these or similar devices 1 for dispensing and especially atomization of cosmetic liquids 3.

In general, the device 1 in accordance with the invention and the metering valve 2 in accordance with the invention can be used for any type of cosmetic liquids 3, as explained above. However, the use of such a metering valve 2 or a similar one is especially well suited for metered dispensing of a cosmetic liquid 3 which contains particles, projections distributed in a metering space 11 of the metering valve 2 being used for temporary deposition of particles in order to counteract bottom-side settling of particles and especially clogging of the inlet valve 9 of the metering valve 2, so that the particles can be discharged again by the liquid in dispensing. In the position of use of the metering valve 2 and container 1, the projections are preferably distributed in the vertical direction or are spaced apart and especially preferably are formed by the turns of the reset spring 12 and/or other recesses, bulges, edges or the like of the valve element 6 and/or valve housing 7 in the metering space 11.

In the delivery of the liquid 2—therefore, when the actuated state of the metering valve 2 is reached—then, the particles which have settled on the projections are entrained by the out-flowing liquid 3, and thus, distributed at least largely uniformly in the liquid 3, especially during subsequently spraying.

What is claimed is:

1. Metering valve for metered dispensing of a liquid, comprising:

a movable valve element, a valve housing, a supply-side inlet valve, the inlet valve having a sealing element for sealing between the valve element and the valve housing with the inlet valve closed, and a dispensing side outlet valve, wherein actuation of the valve element is adapted to first cause the inlet valve to close and only then to cause the outlet valve for metered dispensing of a liquid to open, wherein the sealing element seals radially with the inlet valve closed, wherein the sealing element is secured by a reset spring which acts on the valve element, and wherein the sealing element has a side projection for securing the sealing element by means of the reset spring.

2. Metering valve as claimed in claim 1, wherein the sealing element is at least partially essentially annular or sleeve-shaped.

3. Metering valve as claimed in claim 1, wherein the sealing element is secured on one of the valve element and the valve housing by means of the reset spring.

4. Metering valve as claimed in claim 1, wherein the valve element and the valve housing are made of injection molded plastic.

5. Metering valve as claimed in claim 1, wherein the liquid is a cosmetic liquid.

6. Metering valve as claimed in claim 1, wherein the sealing element is attached to the valve element.

7. Metering valve as claimed in claim 1, wherein the sealing element has been injection molded onto the valve element.

8. Metering valve as claimed in claim 1, wherein the valve element has been injection molded onto the sealing element.

9. Metering valve as claimed in claim 1, wherein the sealing element has been injection molded onto the valve housing.

10. Metering valve according to claim 1, wherein the valve housing has been injection molded onto the sealing element.

11. Metering valve as claimed in claim 1, wherein the sealing element has been inserted into the valve housing.

12. Metering valve as claimed in claim 1, wherein the sealing element annularly surrounds the valve element.

13. Metering valve as claimed in claim 1, wherein the sealing element is supported radially inside by the valve element.

14. Metering valve as claimed in claim 1, wherein at least one of the sealing element, the valve element, and the valve housing is injection molded in one piece.

15. Metering valve (2) for metered dispensing of a preferably cosmetic liquid (3), with a movable valve element (6), a valve housing (7), a supply-side inlet valve (9), and a dispensing side outlet valve (10), wherein the inlet valve (9) has a sealing element (14) for sealing between the valve element (6) and the valve housing (7) with the inlet valve (9) closed, wherein by actuating the valve element (6), first the inlet valve (9) being closable and only then the outlet valve (10) for metered dispensing of a liquid (3) being openable, wherein the sealing element (14) is arranged on the valve element (6) and secured on the valve element (6) by means of a reset spring (12) which is assigned to the valve element (6), characterized in, that the sealing element (14) comprises a side projection for locking or fixing on the valve element (6) by means of the reset spring (12) and is fixed or locked on the valve element (6) by means of the reset spring (12).

16. Metering valve (2) as claimed in claim 15, characterized in that the sealing element (14) is made at least in sections essentially annular or sleeve-shaped, radially seals with the inlet valve (9) closed and is supported radially inside by the valve element (6).

17. Metering valve as claimed in claim 15, characterized in that the sealing element (14) is attached to the valve element (6).

18. Metering valve as in claim 15, characterized in that the sealing element (14) and the valve element are molded to each other.

19. Metering valve as claimed in claim 15, characterized in that the sealing element (14) comprises a ring flange for fixing or locking on the valve element (6) by means of the reset spring (12).

20. Metering valve as claimed in claim 15, characterized in that the sealing element (14) annularly surrounds the valve element (6), and comprises at least one of a truncated cone-shaped or rounded insertion region (15) for one of the valve element (6) and the valve housing (7).

21. Metering valve as claimed in claim 15, characterized in that at least one of the sealing element (14), the valve element (6) and the valve housing (7) are made in one piece.

22. Metering valve as claimed in claim 15, characterized in that at least one of the valve element (6) and the valve housing (7) is produced from one of a polyamide, polyoxymethylene.

23. Metering valve as claimed in claim 15, characterized in that the valve element (6) actuates or forms both the inlet valve (9) and also the outlet valve (10).

* * * * *